US010279818B2

(12) United States Patent
Schmidt et al.

(10) Patent No.: US 10,279,818 B2
(45) Date of Patent: May 7, 2019

(54) METHOD FOR DIRECTING PASSENGERS OF PUBLIC MEANS OF TRANSPORT

(71) Applicant: INIT INNOVATIVE INFORMATIKANWENDUNGEN IN TRANSPORT-, VERKEHRS—UND LEITSYSTEMEN GMBH, Karlsruhe (DE)

(72) Inventors: Ulrich Schmidt, Karlsruhe (DE); Georg Koenig, Waldbronn (DE)

(73) Assignee: INIT INNOVATIVE INFORMATIKANWENDUNGEN IN TRANSPORT-, VERKEHRS—UND LEITSYSTEMEN GMBH, Karlsruhe (DE)

( * ) Notice: Subject to any disclaimer, the term of this patent is extended or adjusted under 35 U.S.C. 154(b) by 138 days.

(21) Appl. No.: 15/503,559

(22) PCT Filed: Jul. 13, 2015

(86) PCT No.: PCT/DE2015/200406
§ 371 (c)(1),
(2) Date: Feb. 13, 2017

(87) PCT Pub. No.: WO2016/023546
PCT Pub. Date: Feb. 18, 2016

(65) Prior Publication Data

US 2017/0232976 A1 Aug. 17, 2017

(30) Foreign Application Priority Data

Aug. 11, 2014 (DE) ..... 10 2014 215 857

(51) Int. Cl.
*B61B 1/02* (2006.01)
*B61L 15/00* (2006.01)
(Continued)

(52) U.S. Cl.
CPC ..... *B61B 1/02* (2013.01); *B61L 15/00* (2013.01); *B61L 15/009* (2013.01);
(Continued)

(58) Field of Classification Search
CPC .... B61L 15/00; B61L 15/0072; B61L 15/009; B61L 15/0027; B61L 27/0077; G09F 19/00; G09F 25/00; H04R 27/00
See application file for complete search history.

(56) References Cited

U.S. PATENT DOCUMENTS

2009/0064719 A1* 3/2009 Koenig ..... D01H 1/00 66/17
2013/0311418 A1* 11/2013 Koenig ..... G06Q 10/047 706/46

(Continued)

FOREIGN PATENT DOCUMENTS

DE 19649280 6/1998
DE 102007046285 4/2009

(Continued)

OTHER PUBLICATIONS

Written Opinion of the International Searching Authority PCT/DE2015/200406 dated Nov. 17, 2015.

*Primary Examiner* — Jason C Smith
(74) *Attorney, Agent, or Firm* — Young & Thompson

(57) ABSTRACT

Disclosed is a method for guiding passengers of public transport, in particular of trams or trains respectively, at stations or in station areas and/or inside the transportation unit. The passengers embark and disembark in the embark-/disembark area via at least two doors, and the embark-/disembark area extends to the length of the vehicle. The method includes: generating a prediction of the occupancy level of the vehicle with regard to the resulting situation in the vehicle after disembarking at each stop; distributing of the passengers which are moving to the entry area and/or
(Continued)

Figure 1:
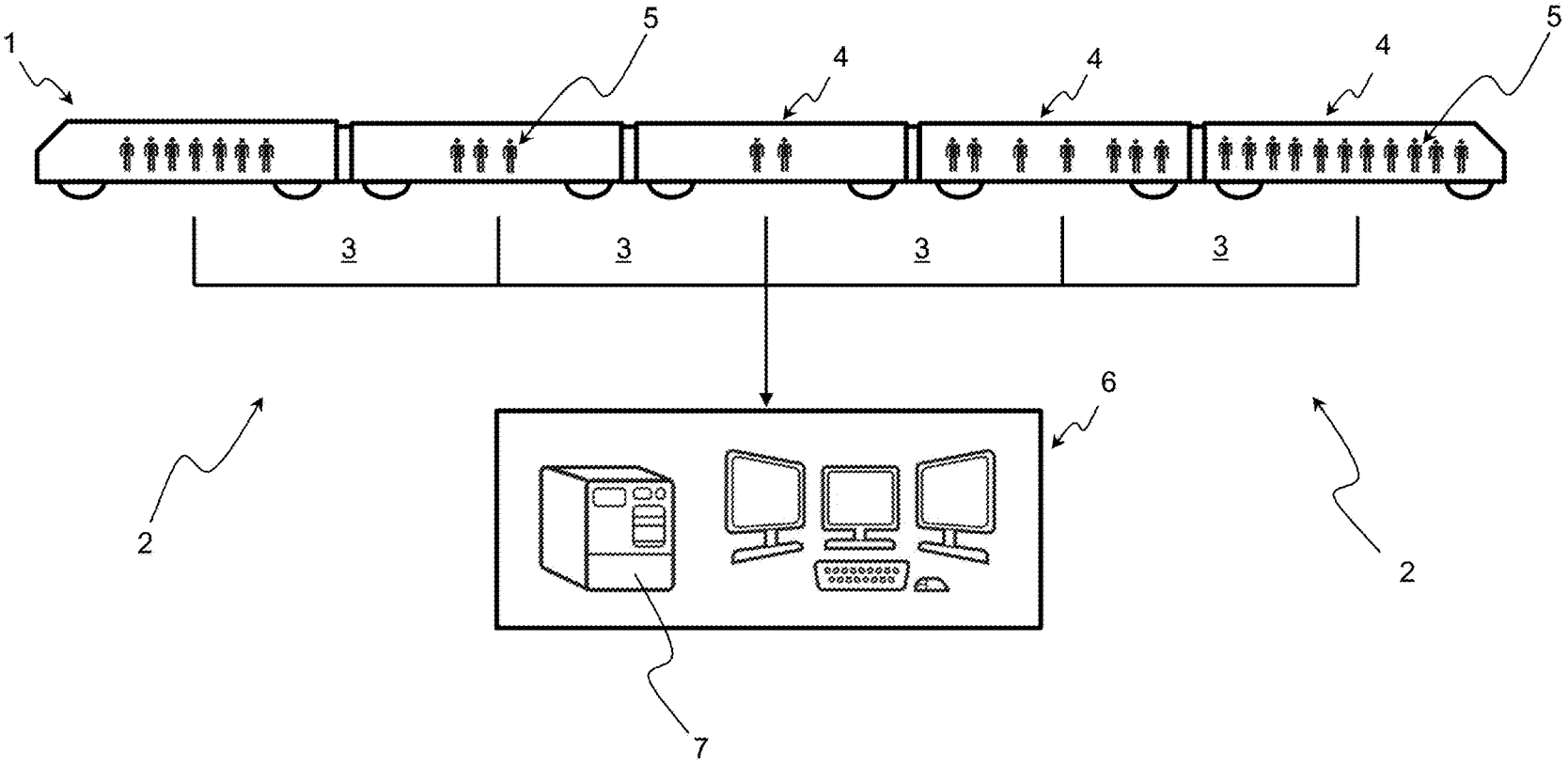

waiting in the entry area ready for embarking corresponding to the prediction to the area of the doors for an approximately uniform distribution of the passengers inside the vehicle; and if applicable, distribution of the passengers inside the vehicle under consideration of the predicted, preferably section-wise occupancy level and of the passengers actually ready for embarking.

17 Claims, 2 Drawing Sheets

(51) Int. Cl.

| | |
|---|---|
| ***B61L 27/00*** | (2006.01) |
| ***G09F 19/00*** | (2006.01) |
| ***G09F 25/00*** | (2006.01) |
| ***H04R 27/00*** | (2006.01) |

(52) U.S. Cl.

CPC ..... *B61L 15/0072* (2013.01); *B61L 27/0077* (2013.01); *G09F 19/00* (2013.01); *G09F 25/00* (2013.01); *H04R 27/00* (2013.01); *B61L 15/0027* (2013.01); *H04R 2499/13* (2013.01)

(56) References Cited

U.S. PATENT DOCUMENTS

| | | | | |
|---|---|---|---|---|
| 2016/0222716 | A1* | 8/2016 | Kim | E05D 13/00 |
| 2017/0232976 | A1* | 8/2017 | Schmidt | B61L 15/0072 104/28 |

FOREIGN PATENT DOCUMENTS

| | | | |
|---|---|---|---|
| DE | 102011011062 | | 8/2012 |
| DE | 102011081851 | | 2/2013 |
| GB | 2508743 | | 6/2014 |
| GB | 2508743 B | * | 6/2017 |
| WO | 2006032625 | | 3/2006 |

* cited by examiner

METHOD FOR DIRECTING PASSENGERS OF PUBLIC MEANS OF TRANSPORT

The invention relates to a method for guiding passengers of public transport, in particular of trams or trains respectively, at stations or in station areas and/or inside the transportation means, wherein the passengers embark and disembark in a embark-/disembark area via at least two doors, usually via a plurality of doors, wherein the embark-/disembark area extends to the length of the vehicle.

Methods of said kind are already known from practice. In the long-distance traffic there are already seat reservations, so that the passengers can be allocated to the whole train, however solely with regard to those passengers which have made use of the possibility of a reservation.

Spontaneous passengers or passengers with indefinite traveling times after business meetings, meetings, conferences, etc. take the train, which departs promptly to the desired destination. Therefore a uniform distribution of the passengers to the individual carriages or compartments respectively is nearly impossible.

There is also signaling, which shows the occupation of the trams more or less reliably. Insofar the embarking passengers can be geared to the displayed occupancy level and spreading to carriages or compartments which are not occupied all too much. The occupancy level is determined with the help of automatic passenger counting systems, which are arranged in the area of the doors and also inside the carriages and compartments and which are being linked at least with regard to the whole train.

Until now there are no reliable methods which consider the expected passengers of the respective carriages to debark. Statistical knowledge about the expected passengers to debark is either not known or is not considered due to its limited reliability.

The number of persons to embark in total for each platform area is also not known. Passengers are therefore not informed about the "best" areas for embarking for the current stop and the current trip.

Due to the problems mentioned above jams also occur during embarking, for example in underground railways near escalators. If passengers were guided to compartments being a little farther away, the procedure of embarking would be significantly reduced in time. Further the always occurring pushing with inconvenience for the passengers would not occur.

Neither in the long-distance traffic nor in the local traffic it is possible to reduce the traveling times to a great extent. This is due to the kilometric performance of the vehicles and the conditions of the respective line. Consequently the total traveling time especially in the local traffic can only be reduced by accelerating the procedure of embarking and disembarking. With that stop times of the trams can be decreased and the traveling speed can be in total increased.

Based on the consideration above the problem of the invention is to overcome the disadvantage of the prior art concerning the traveling time, i.e. to achieve a higher traveling speed. Simultaneously the comfort of the passengers shall be increased. The cost for the trips shall be reduced. Furthermore panic behavior in emergency situations is reduced due to the enhanced distribution of the passengers inside the train.

The problem mentioned above will be solved by the features of patent claim 1. As mentioned above the invention is based on the consideration that the traveling time is for example not reduced by increasing the speed of the trains but by influencing the embark and disembark behavior of the passengers, namely by distributing the passengers onto the whole train, if applicable under consideration of their ticket category—first class of second class. Such a distribution does only work if the occupancy level of the respective areas in the vehicle is considered.

In detail the method according to the invention comprises the following procedural steps:

First of all a prediction of the occupancy level of the vehicle with regard to the resulting situation inside the vehicle after disembarking at each stop is generated. Based on this prediction a distribution of the embarking passengers can be performed, wherein a distribution of the passengers moving into the entry area and/or being in the entry area ready for embarking is performed based on the prediction to the area of the doors such to provide an approximately uniform distribution of the passengers inside the vehicle. Here it is essential that the distribution of the passengers can be performed already on the way to the concrete entry areas, namely by guiding the passengers moving thereto. Simultaneously a re-distribution of the passengers already being in the area of the doors can be performed if the approaching train is not uniformly occupied and/or if the passengers inside the train based on the prediction will disembark the vehicle non-uniformly.

Further it is possible, that the passengers inside the vehicle under consideration of the predicted occupancy level, preferably per sector, and of the passengers being ready to embark in fact are redistributed inside the vehicle to guarantee at the next stop an approximately uniform distribution and by that embarking and disembarking in the fastest possible way. The teaching according to the invention is accompanied by an increase in the comfort of the passengers since pushing during embarking and/or disembarking is as far as possible avoided by such a distribution.

With regard to the teaching according to the invention it has to be noted that it is a method for spatial control of the occupancy level of public transport and therefore a method for spatial control of passengers. The passengers will be guided at the respective stops such that the disembark/embark and change times at the stops are reduced by which the vehicle stop times are reduced and their travelling speed is increased in total.

The teaching according to the invention leads to a higher provision of trips, a reduction of the embarking and disembarking times, a reduction of the traveling time in total, an increase in the comfort of passengers by uniform distribution of the passengers inside the vehicles and if applicable at the platforms and finally to a reduction in the costs due to a reduction in the trip times.

The problems occurring in the state-of-the-art result in general from not knowing the zonal occupancy level inside the vehicles, whereby an optimization during embarking and disembarking is nearly impossible. Only on the basis of the prediction of the occupancy level inside the vehicle a distribution of the passengers to the individual entry areas of the vehicles is possible with the result of a reduction of the stop times.

For generating the prediction a prediction model is taken as a basis, namely real time prediction model which is used for determining the predicted occupancy level for the time after disembarking of the passengers at the respective stop. For determination of the occupancy level the following data is used respectively aggregated in the framework of an application of the prediction model:

Per carriage/compartment/area in the vehicle the actual occupancy level is determined, preferably by usage of known automatic passenger counting systems, which are provided in the area of the doors and inside the vehicle, preferably in transient sections.

A prediction of the number of passengers disembarking at the next stop follows, preferably based on statistical determined data of the past. This data can be day- and time-dependent, for example under consideration of the rush hour in the morning and in the evening as well as under consideration of concrete weekdays, public holidays, holiday seasons, etc.

Further a consideration of an emerging of passengers due to one or more events is possible, for example the consideration of the current weather. Here methods can be used, which are for example known from DE 10 2011 011 062 A1. The knowledge is based on that the behavior of the passengers changes subject to different influences, so for example subject to the weather. Public transport is much more used during heavy rain, onset of winter, etc. than when the weather is fine, without road congestions.

As already mentioned before the filling level in the embarking/disembarking areas and if applicable the local occupancy level inside the vehicles is determined by passenger counting systems in the entry areas and inside or on the vehicle respectively. The data/numbers determined in that manner reflect the actual situation. Already this data is suitable to distribute the passengers, namely the passengers moving into the entry areas, the passengers ready for embarking in the entry areas and the passengers inside the vehicle in case this is necessary.

The distribution of the passengers is performed according to the invention based on the prediction, in fact by transmitting acoustic and/or optical information for the passengers in front of the entry area, in the entry area and/or inside the vehicle itself.

The information can be provided in form of visualized information, preferably on fixed displays arranged in front of or in the entry areas respectively and/or inside the vehicles.

Already present displays can be used. Insofar the mechanistic build-up for realizing the method according to the invention is small.

The visualization can comprise a display of preferred entry areas in feeder areas and/in the entry areas, such that moving passengers can be selectively redirected or forwarded respectively. The display can comprise symbols, for example in the form of colors (red, yellow, green) or in form of pictograms, but can also be provided in form of writing. Arbitrary presentations are possible, wherein uniform symbols, for example pictograms, are preferred.

It is further possible that alternatively or additionally the information is provided as announcements in feeder areas and/or in the entry area and/or inside the vehicle. So in particular announcements with a synthetic voice are possible similar to the known navigational systems of a car.

It is further possible in a particular sophisticated manner, that information is provided via portable terminals, preferably by push messages, via organizer and loaded apps thereon. If such an app is installed, it could be adapted such that the organizer is activated when approaching the stop area and—automatically—provides the necessary information for optimized embarking acoustically and/or visually. The passenger can in such a way be guided via organizer, to experience the maximum comfort already during embarking. The stop time at the respective stop is reduced.

Simultaneously to providing this information via app already present information panels, displays, etc. as well as speakers can be used for acoustic displaying. Displays in the window area of the transport means can be used too, for example to indicate an overcrowded compartment which is also after the predicted disembarking still overcrowded or well filled.

The necessary information for guiding the passengers can be directly prepared and provided decentralized from the vehicles or via a control center. This data can also be used for further processing or preparation respectively, in particular for collecting statistical data, which are then considered for the prediction model.

Figure 2:
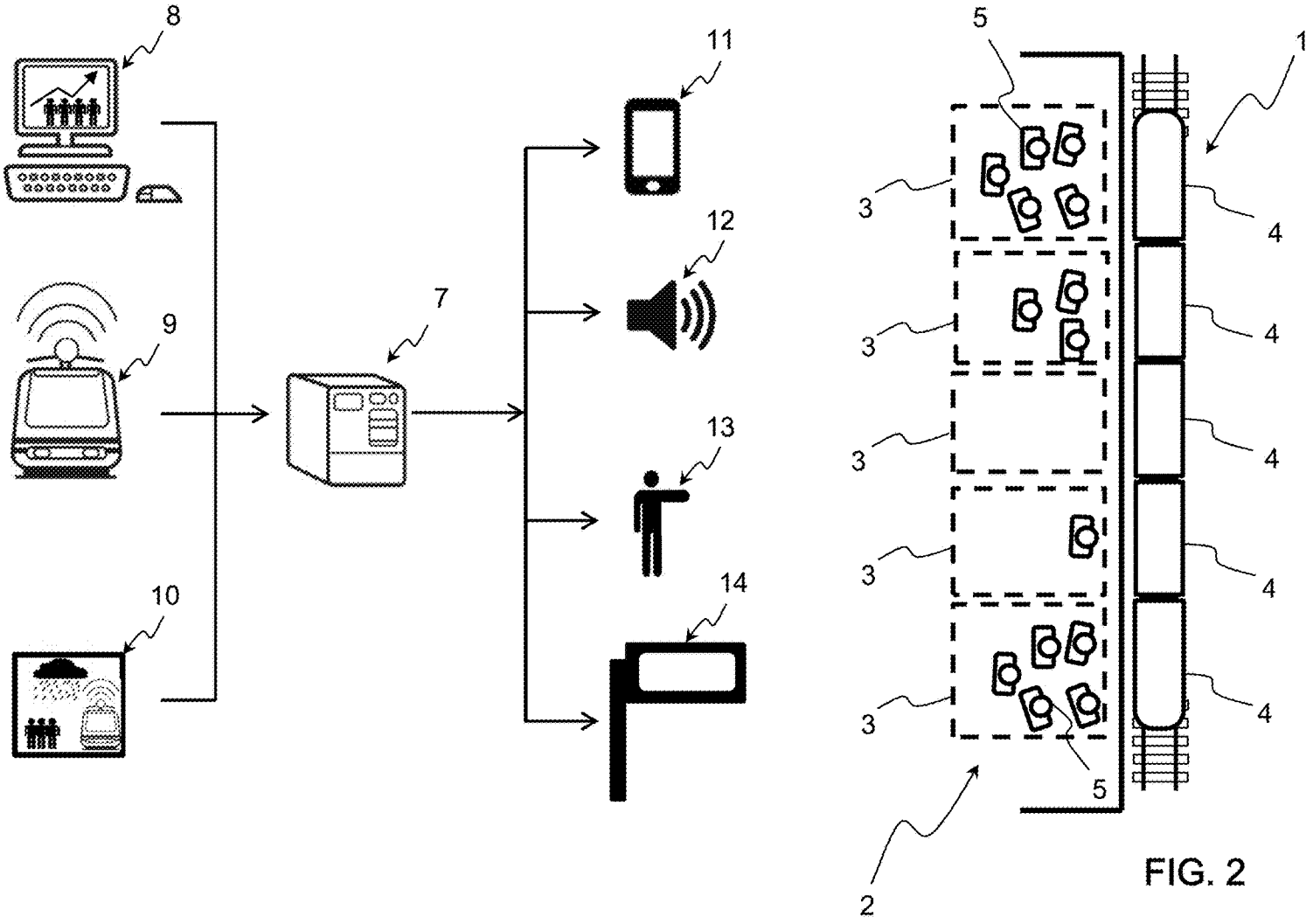

There are several ways to design and further develop the teaching of the present invention. To this end it is to be referred to the patent claims subordinate to claim 1 on the one hand and on the other hand to the following explanation of a preferred embodiment of the invention, illustrated by the figure. In connection with the explanation of the preferred embodiment of the invention by aid of the figure, generally preferred embodiments and further developments of the teaching will also be explained. In the drawings FIG. 1 shows in a schematic view the principle application of the method of the invention by means of example of a train comprising a plurality of carriages/compartments and;

FIG. 2 shows in a schematic view the method according to the invention by using of different information, wherein information is provided to the passengers for fast embarking by different display means.

FIG. 1 shows a train 1, which has stopped at an indicated stop 2 respectively a platform. The platform comprises a plurality of platform areas 3.

The train 1 comprises a plurality of carriages 4, wherein they can also be provided as integral compartments.

Inside the train 1, i.e. the carriages 4 or the compartments respectively, there are passengers 5, which are recognizably non-uniformly distributed onto the carriages 4 or compartments respectively. This is a result of the embarking behavior of the passengers 5 at the respective stops 2.

The method is based on a prediction of the occupancy level of the train 1, whereby it is determined how many passengers 5 at the next stop 2 are leaving the train 1 or the carriages/compartments 4 respectively. Knowledge of the current occupancy level per carriage/compartment 4 is beneficial. Based on statistical data 8 of the past a distribution instruction is computed by a central computer 7 assigned to the train 1 or assigned to a control center 6 and provided to the passengers 5. The central computer 7, which can also be assigned to the train 1, comprises the passenger guiding system, wherein the respective data of individual trains 1 can also be linked together, for example in the regard, that in the local traffic, passengers 5 is recommended, to wait for some minutes and to embark the next train 1.

In any way relevant for the method according to the invention is that a distribution of the passengers 5 is performed, in the simplest case at the respective stop 2 across the platform areas 3 prior to the compartments 4 of the train 1 to stop.

FIG. 2 shows in detail the function of the method according to the invention, namely the passenger guiding system defined in this way.

On the right side of the drawing in FIG. 2 a train 1 at a stop 2 is shown, wherein sideways of the train 1 the platform areas 3 are indicated with the waiting passengers 5. A situation is shown wherein the passengers 5 stand in their platform areas 3 non-uniformly under consideration of the prediction and due to transmitted information. The non-uniform distribution of the passengers 5 considers the occupancy level of the train 1 and in particular the predicted disembarking of passengers 5 of the respective carriages 4 or compartments respectively.

On the left side of the drawing of FIG. 2 a control center 6 is shown with the central computer 7. The central computer 7 receives different data to generate a prediction and finally to generate instructions for the passengers 5. The central computer 7 uses statistical data 8, which is generated from the passenger behavior of the past. The statistical data 8 can be continuously revised or adapted respectively.

Further the central computer 7 obtains information 9 from the train 1, wherein primarily it is information 9 concerning the local occupancy level of the train 1.

Further information can be transmitted to the central computer 7 concerning one or more events, for example weather data 10, wherein it is known that passenger a behavior is strongly weather—dependent.

All the data 8, 9 and/or 10 is provided to the central computer 7, wherein the control center 6 comprising the central computer 7 can be assigned to the train 1 or a central office.

The central computer 7 forms the passenger guiding system and computes under consideration of the prediction the expected occupancy level in the respective carriages/compartments 4, for providing information and if applicable instructions to the passengers 5 moving to the platform areas 3 or waiting there, in which areas they should preferably embark, namely to reduce the embarking times and to increase the comfort during embarking and disembarking for the passengers 5. This information can be provided audio-visually, for example via a smart phone 11 respectively an organizer, via speakers 12 and a respective speaker announcement, via personnel 13, which works on-site in the respective platform areas 3 or via display means 14 located on the way to the platform areas 3 or in the platform areas 3, which are already present for train display. The provision of special display means 14 is possible.

With regard to further preferred embodiments of the method according to the invention it is referred here to the general part of the description as well as to the appended claims to avoid repetition.

Finally it has to be explicitly noted that the foregoing embodiment of the method according to the invention is only used to explain the claimed teaching but does not limit the teaching to the embodiment.

LIST OF REFERENCE SIGNS

1 train (vehicle)
2 stop/platform
3 Platform area/entry area
4 carriage/compartment
5 passenger
6 control center (in the train or in a central office)
7 central computer (in the control center)
8 statistical data
9 information from the train
10 weather data, weather specific parameter
11 smart phone, organizer
12 speakers
13 personnel
14 displaying device, display

The invention claimed is:

1. A method for directed guiding of passengers of public transport, in particular of trams or trains (1) respectively, at stations (2) or in station areas and/or inside the transportation means, wherein the passengers (5) embark and disembark in the embark-/disembark area via at least two doors, mostly via a plurality of doors, wherein the embark-/disembark area extends to the length of the vehicle (1), the method comprising:

computing a prediction of the occupancy level of the vehicle (1) with regard to the resulting situation in the vehicle (1) after disembarking at each stop (2), under consideration of the filling level in the entry areas (3) and when applicable the local occupancy level inside the vehicles (1) being determined by passenger counting systems in the entry areas and inside or on the vehicle (1) respectively, guiding of the passengers (5) which are moving to the entry area (3) and/or waiting in the entry area (3) ready for embarking corresponding to the prediction to the area of the doors for an approximately uniform distribution of the passengers (5) inside the vehicle (1) by transmission of acoustic and/or optical information to the passengers (5) in front of or in the entry area (3) and inside the vehicle (1), and guiding of the passengers (5) inside the vehicle (1) under consideration of the predicted occupancy level and of the passengers (5) actually ready for embarking.

2. The method according to claim 1, wherein for generating the prediction a prediction model is used.

3. The method according to claim 2, wherein the prediction model uses the following data:

current occupancy level per carriage/compartment/area (4) inside the vehicle;

prediction of the number of disembarking persons at the next stop, in particular based on determined statistical data (8) of the past;

if applicable considering passenger appearance due to one or more events;

current filling level of the entry areas (3).

4. The method according to claim 3, wherein the information is provided as visualized information.

5. The method according to claim 4, wherein the visualization comprises the indication of preferred entry areas (3) in the feeder areas and/or in the entry areas (3).

6. The method according to claim 4, wherein the visualized information are at least partially provided in form of pictograms.

7. The method according to claim 3, wherein the information is provided as announcements in feeder areas and/or in the entry area (3) and/or inside the vehicle (1).

8. The method according to claim 3, wherein the information is provided via portable terminals.

9. The method according to claim 3, wherein weather specific parameters (10), if applicable a prediction model is used for the passenger behavior during the course of the day/week/and/or year based on it for including the passenger appearance based on one or more events.

10. The method according to one of the claim 1, wherein the information is prepared and provided directly out of vehicles (1) in a decentralized manner or via the control center (6).

11. The method of claim 1, wherein in the distribution step, the occupancy level considered is the section-wise occupancy level.

12. The method of claim 8, wherein the information provided by portable terminals is provided by push messages via organizer (11) and loaded apps thereon.

13. The method according to claim 5, wherein the visualized information are at least partially provided in form of pictograms.

14. The method according to claim 4, wherein the information is provided as announcements in feeder areas and/or in the entry area (3) and/or inside the vehicle (1).

15. A method for directed guiding of passengers of public transport into vehicles (1), including trams and trains (1), wherein the passengers (5) embark and disembark in the embark-/disembark area via a plurality of doors into the vehicles (1) from entry areas (3), wherein the embark-/disembark area extends to a full length of the vehicles (1), the method comprising:

computing a prediction of an occupancy level of each of the vehicles (1) with regard to a resulting situation in each vehicle (1) after disembarking at each stop (2), wherein a filling level in the entry areas (3) and local occupancy level inside the vehicles (1) is determined by passenger counting systems in the entry areas (3) and on the vehicles (1) respectively;

directed guiding of the passengers (5) which are moving to the entry area (3) and waiting in the entry area (3) ready for embarking corresponding to the prediction to the area of the doors for an approximately uniform distribution of the passengers (5) inside each of the vehicles (1) by transmission of information to the passengers (5) in front of and in each of the entry areas (3) and inside the vehicles (1); and directed guiding of the passengers (5) inside the vehicles (1) under consideration of the predicted occupancy level and of the passengers (5) actually ready for embarking.

16. The method according to claim 15, wherein, a prediction model is used for generating the prediction, the prediction model uses the following data:

current occupancy level per carriage/compartment/area (4) inside the vehicles;

prediction of the number of disembarking persons at the next stop, based on determined statistical data (8) of the past;

considering passenger appearance due to one or more events; and current filling level of the entry areas (3).

17. The method according to claim 16, wherein the consideration of passenger appearance due to one or more events uses a prediction model for the passenger behavior during the course of the day/week/and/or year based on weather specific parameters (10).

* * * * *